US008180079B2

(12) United States Patent
Bindner et al.

(10) Patent No.: US 8,180,079 B2
(45) Date of Patent: May 15, 2012

(54) METHOD AND APPARATUS FOR SETTING A HEARING DEVICE

(75) Inventors: Jörg Bindner, Weisendorf (DE); Ingo Eichinger, Erlangen (DE); Claus Reinlein, Burgthann (DE); Robert Ryman, Bucks (GB); Michael Sainsbury, Horsham (GB)

(73) Assignee: Siemens Medical Instruments Pte. Ltd., Singapore (SG)

( * ) Notice: Subject to any disclaimer, the term of this patent is extended or adjusted under 35 U.S.C. 154(b) by 933 days.

(21) Appl. No.: 12/228,918

(22) Filed: Aug. 18, 2008

(65) Prior Publication Data

US 2009/0052705 A1 Feb. 26, 2009

(30) Foreign Application Priority Data

Aug. 20, 2007 (DE) ..... 10 2007 039 185

(51) Int. Cl.
*H04R 25/00* (2006.01)

(52) U.S. Cl. ..... 381/314; 381/303

(58) Field of Classification Search ..... 381/314, 381/303, 23.1, 312, 328, 330
See application file for complete search history.

(56) References Cited

U.S. PATENT DOCUMENTS

| | | | | |
|---|---|---|---|---|
| 2004/0208330 | A1 * | 10/2004 | Chalupper et al. | 381/314 |
| 2006/0067549 | A1 * | 3/2006 | Puder et al. | 381/315 |
| 2010/0020992 | A1 | 1/2010 | Flynn | |

FOREIGN PATENT DOCUMENTS

| | | | |
|---|---|---|---|
| EP | 1416764 | A2 | 5/2004 |
| EP | 1453 358 | A2 | 9/2004 |
| WO | 0113674 | A2 | 2/2001 |
| WO | 2008049453 | A1 | 5/2008 |

* cited by examiner

*Primary Examiner* — Jerome Jackson, Jr.
*Assistant Examiner* — Dale E Page

(57) ABSTRACT

A method and apparatus for setting a characteristic of a source hearing device on target hearing device are provided. A transformation database is created. A source hearing device including the setting of the source hearing device are identified, the characteristic of setting is to be set on the target hearing device. The setting which, according to the transformation database on the target hearing device, results in the characteristic corresponding to the characteristic of the identified source hearing device is recalled. The target hearing device is set using the recalled setting. Settings are stored in the transformation database during their creation, which have to be set to hearing devices of different types to be set in order to grant these hearing devices the characteristic of other identified hearing with identified settings.

18 Claims, 4 Drawing Sheets

METHOD AND APPARATUS FOR SETTING A HEARING DEVICE

CROSS REFERENCE TO RELATED APPLICATIONS

This application claims priority of German application No. 10 2007 039 185.6 DE filed Aug. 20, 2007, which is incorporated by reference herein in its entirety.

FIELD OF INVENTION

The invention relates to a method and an apparatus for setting a characteristic of a hearing device to another hearing device, in particular after replacing an old hearing device with a new hearing device.

BACKGROUND OF INVENTION

Hearing devices generally have a plurality of settings, in order to allow the wearer of a hearing device as natural a hearing perception as possible and/or to enable individual preferences of the hearing device wearer to be incorporated into the setting of his/her personal hearing device. The setting of a hearing device is in this way generally firstly performed in the form of a presetting of a parameter set, which can only be attuned relatively roughly to the expected requirements of the hearing device wearer. At the outset of the actual use of the hearing device, fine tunings then take place at short intervals, which result in an improved parameter setting and either in several consecutive sessions being undertaken with a hearing device acoustician or being implemented by the hearing device wearer him/herself with the aid of specific optimization algorithms. Frequently, after a parameter optimization of this type, no further parameter adjustments are performed over lengthy periods of time. As a result, a hearing device wearer, in particular a hearing-impaired person, becomes accustomed to the transmission properties of his/her hearing device through the constant wearing thereof, which relates in particular to the sound of the hearing device, but also to different implied signal processing algorithms and their effect.

SUMMARY OF INVENTION

The exchange of a hearing device is necessary in certain situations. This may arise for instance as a result of a worsening or change in the hearing ability of the hearing device wearer, other exemplary situations are found following technical defects in the hearing device to be exchanged and/or a desire for convenience functions which have in the interim become available and/or an otherwise increased functional diversity of modern hearing devices. The changeover of a hearing device always risks the hearing device wearer perceiving the sound of the new hearing device as unusual and abnormal due to their becoming accustomed to the old hearing device and then under certain circumstances refusing the changeover of the hearing device. Attempts are thus sometimes made to obtain a hearing device of the same model in the case of the necessary changeover of the hearing device, which in times of rapid technical advances may already prove difficult for reasons of availability, and practically cuts the user of the hearing device off from technical developments. It is as a result known to increase the acceptance of a changeover of the hearing device such that an attempt is made to set the sound or generally the transmission properties of the new hearing device by specifying corresponding parameter settings such that the subjective impression communicated thereto by the new hearing device, largely corresponds to that of the old hearing device. In the event of a manual specification of these parameter settings, in particular by means of a hearing device acoustician, the identifying of an often only subjectively justifiable setting is frequently associated with an extremely high degree of effort and/or is barely realizable against the background of the now enormous complexity of modern hearing devices, if technical functions which have in the meantime become available are not to be ruled out completely. The effort involved in the parameter setting also logically applies to methods in which the setting of a new hearing device takes place in several stages, which are performed at chronological intervals which are to allow for the acclimatization of the hearing device and is associated with step by step settings which are technically expedient for the new hearing device, with settings likewise firstly having to be found, with which the new hearing device largely conveys the subjective impression which the hearing device wearer has become accustomed to from his/her old hearing device.

Methods are known in which a first setting of a new hearing device is performed in a computer-assisted fashion after replacing an old hearing device, with customer or patient wishes largely being allowed for following the extensive retention of usual transmission properties of the hearing device. The specification of the first parameter settings can as a result be largely automated (EP 1453 358 A2). These methods are essentially based on an analysis of the first hearing device and/or hearing device to be replaced and the provision of the analysis result in a form suitable for computerized evaluation, building upon a determination of setting parameters of the second or new hearing device with the knowledge of the transmission characteristics of the first hearing device and a subsequent application of the setting of these determined parameters on the new hearing device. The analysis of the first hearing device can be carried out in terms of measuring technology, by input acoustic signals being provided and output acoustic signals generated on the hearing device output being detected and evaluated. This method is relatively complicated but can however be applied to all acoustic pressure-generating hearing aids. With other hearing aids, other hearing-stimulating output variables must be evaluated instead of the output acoustic signals. The outlay involved in the analysis of the first hearing device can be reduced if the existing parameter settings are provided instead of a complete adjustment and a simulation of the characteristic of the first hearing device is performed on the basis of the knowledge of these adjustments with the aid of a corresponding model. It is however imperative for the automation of the parameter settings on the new hearing device to know which parameter settings are to be performed on the new hearing device, so that the hearing impression and/or the transmission characteristic develops, which largely correspond to those of the old hearing device with the determined parameter settings and/or the determined transmission characteristic. This knowledge is generally available if hearing devices are exchanged which belong to the same batch or a model family of one and the same manufacturer, but is however frequently not available if the hearing device changeover is associated with a changeover of supplier, which frequently intentionally foregoes the compatibility details and/or renders inaccessible details which were necessary for a complete modeling of his/her hearing device component.

The object of the invention thus consists in indicating a possibility of being able to perform a largely automated setting of parameters of a hearing device while allowing for customer and/or patient wishes according to a conventional hearing device characteristic, even if the complete characteristic of the hearing device is not known. This is to take place with the minimum possible outlay.

The object is achieved by a method and an apparatus having the features of the independent claims. The dependent claims specify advantageous embodiments.

The invention relates to parameter settings being performed during the replacement of a source hearing device, for instance an old hearing device, by a target hearing device, for instance a new hearing device, in the form of a first-fit setting, which can be taken from a transformation database. The creation of this transformation database is carried out such that the transmission characteristic of the source hearing device is first determined for a discrete number of parameter sets, which can be set on the source hearing device to be replaced. A parameter setting is then performed on a target hearing device which is to replace the source hearing device, during which an identical or at least similar transmission characteristic of the target hearing device is set in each instance. The parameters required to achieve these characteristics on the target hearing device are recorded and stored in the transformation database. This procedure is repeated for a number of possible target hearing devices, which are to be considered for a replacement of the source hearing device to be replaced. For further hearing devices, for which the replacement thereof is expected, a data acquisition can be performed in a similar fashion. A transformation database is obtained in this way, in which parameter sets queried in advance of the hearing device exchange are stored, which depend on the type of the source hearing device to be replaced, the type of the target hearing device as well as on the parameter set and/or setting which has led to a desired characteristic on the source hearing device to be replaced, which was however adjusted last for instance.

The determination of the parameters which are to be set on the target hearing device in order to achieve transmission characteristic which corresponds to that of the source hearing device with a specific parameter set, can take place iteratively in a manner known per se or implemented using potentially available modeling methods taking dynamic or static models as a basis.

It is decisive for the efficiency of the method according to the invention for the number of possible parameter settings, which are to be detected in the manner illustrated in terms of measuring technology, to be restricted such that the effort for the inventive primary determination of the settings required for a transition from one hearing device type to another remains acceptable as a basis of the transformation database. The number of possible combinations of parameters is restricted at the outset for hearing devices with a restricted number of settable parameters, which can only be varied in discrete steps. For hearing devices with control elements, with which parameters can be continuously adjusted, it is advantageous for implementation of the method according to the invention to subdivide the adjustment range into discrete control steps in order to restrict the number of possible parameter combinations to a finite value. When determining the step size of this adjustability, conditions concerning convenient data management, storage capacity, but also aspects of the perceptibility of certain parameter adjustments and/or their effect can be taken into consideration in terms of the transmission characteristic of the relevant hearing device. By way of example, simple tests, by which absolute or relative value a parameter has to be changed, can be determined in order to result in reliably perceptible changes in the transmission characteristic of the hearing device. Hence, a step size can be determined in order to implement the method according to the invention, which is broader than the step size of the smallest perceptible adjustment, with averaging across a typical patient group being possible since a narrower step size would for subjective reasons generally not determine a perceptible improvement in the setting accuracy, but on the other hand must increase the effort for the data management and data acquisition.

The invention generally consists of a method for setting a characteristic of a hearing device on another hearing device, including the steps:

creating a transformation database, identifying a source hearing device $U_x$ including the setting $C_y$ of this source hearing device, the characteristic of which is to be set on the target hearing device $Z_z$ to be set, calling up the setting C ($Z_z$, $U_x(C_y)$), which, according to the transformation bank on the target hearing device $Z_z$ to be set, results in the characteristic which corresponds to the characteristic of the identified source hearing device $U_x$ including the identified setting $C_y$ and setting the called-up setting C ($Z_z$, $U_x(C_y)$) on the target hearing device $Z_z$ to be set with settings being stored in the transformation database during their setting, which must be set on hearing devices $Z_1$ to $Z_{max}$ of different types to be set in order to grant these hearing devices the characteristic of other identified hearing devices $U_1$ to $U_{max}$ with identified settings $C_1$ to $C_{max}$.

The invention can also be used if all possible combinations of hearing devices and characteristics to be reproduced are not stored in a transformation database in the form of stored data sets. Significant benefits already result if individual or however particularly frequent combinations or combinations occurring with considerable probability can be called up in the form of the inventively generated data sets in the transformation database. For the creation of the transformation database, at least one source hearing device $U_x$ is adjusted acoustically with at least one setting $C_y$. The setting C ($Z_z$, $U_x(C_y)$) is determined on at least one target hearing device $Z_z$, with which the target hearing device $Z_z$ has a characteristic which equates to that characteristic which was determined by the acoustic adjustment of the source hearing device $U_x$. The parameters of this setting C ($Z_z$, $U_x(C_y)$) are linked to the type $U_x$ of the source hearing device, the adjusted setting $C_y$ of the source hearing device and the type $Z_z$ of the target hearing device and are stored as a data set.

The value of the transformation database naturally increases with its data stock, as a result of which the typical procedure consists in several different settings $C_y$ being acoustically adjusted for the creation of the transformation database on several source hearing devices $U_x$, the settings C ($Z_z$, $U_x(C_y)$) being determined on several target hearing devices $Z_z$, with which the target hearing devices $Z_z$ have a characteristic which equates to that characteristic in each instance which was determined by the acoustic adjustment of the source hearing devices $U_x$, and the parameters of the settings C ($Z_z$, $U_x(C_y)$) are linked to the type $U_x$ of the source hearing devices, the adjusted settings $C_y$ of the source hearing devices and the type $Z_z$ of the target hearing devices and are stored as data sets.

The invention can be used in particular when repairing damaged hearing devices. With damaged hearing devices, it is namely often no longer possible as a result of the damage to accurately determine the hearing device characteristic so that a complex readjustment would be necessary following the repair process. This can be easily solved using the method according to the invention, with which the characteristic can be reproduced by way of the transformation database.

BRIEF DESCRIPTION OF THE DRAWINGS

The invention is described in more detail with reference to exemplary embodiments, in which.

DETAILED DESCRIPTION OF INVENTION

Figure 1:
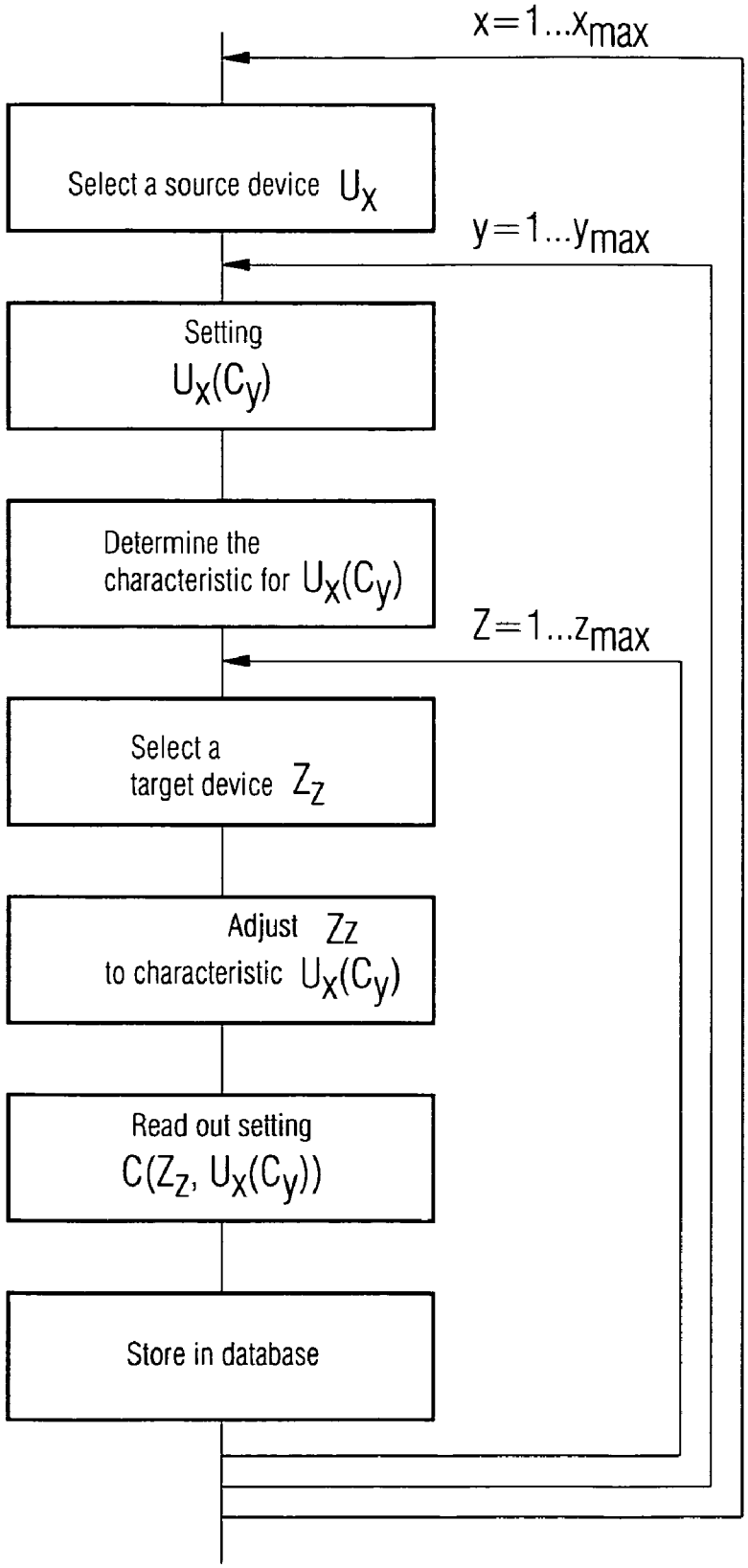
FIG. 1 shows a program flowchart of the inventive method during the creation of the transformation database.

FIG. 1 shows a program flowchart of the inventive method during the creation of the transformation database. In a first step, a source hearing $U_x$ is selected, the replacement of which by another hearing device is to be prepared. A variation of possible settings is performed on this source hearing device. The individual setting is designated below using $C_y$, with the settings $C_y$ depending on the technical possibilities of the source hearing device $U_x$, as a result of which the respective setting can be described completely by $U_x(C_y)$. The diversity of possible settings results here from the number of parameters and/or control variables which can be variable independently of one another as well as the number of steps, in which these parameters and/or control variables can be adjusted. With continuously adjustable control variables, a division of the adjusting range into a finite number of discrete steps is needed in order to restrict the number of possible settings. For each of the performed settings $U_x(C_y)$, a characteristic of the source hearing device $U_x$, which describes the acoustic behavior thereof, is determined in a further step. The transmission and amplifying characteristics of the hearing device are particularly suited to this. The selection of a target hearing device $U_z$, which is considered for the replacement of the source hearing device $U_x$, is carried out in a further step. Such a setting of its settable parameters and/or control variables is performed on this target hearing device by means of suitable measures, which lead to a characteristic of the target hearing device $Z_z$, which corresponds to the characteristic of the source hearing device $U_x$ during the setting $C_y$. Different forms of parameter variations are among suitable measures which lead to the desired setting on the target hearing device $Z_z$, said variations being able to allow and/or facilitate a targeted location of a predetermined characteristic. To this end, a continuous adjustment of the target hearing device to be set is necessary in order to be able to reproduce the effect of the performed adjustments. After locating the target setting, which leads to a characteristic of the target hearing device $Z_z$, which equates to that of the source hearing device $U_x(C_y)$ with the corresponding setting or at least only deviates marginally herefrom, with it being possible to determine the marginality of the deviation in a qualified manner by specifying a tolerance range, the setting C $(Z_z, U_x(C_y))$ needed to achieve this characteristic is read out in a further step on the target hearing device $Z_z$ and is stored in a transformation database. The setting C $(Z_z, U_x(C_y))$ can be read out from this transformation database at any time and used for a presetting of a target hearing device $Z_z$, if this target hearing device is to replace a source hearing device $U_x$ with the setting $C_y$. The procedure for investigating the values required for the transformation database is repeated up to a maximum number $z_{max}$ for each target hearing device $Z_z$. The value $z_{max}$ is determined for instance from the number of hearing device models to be considered, which come into question for a replacement of older hearing devices. Furthermore, the complete sequence for each of these hearing devices which is potentially available for replacement purposes for each setting $C_y$ is to be run and is completely repeated again for each of these source hearing devices with the prospective replacement of different source hearing devices $U_x$.

As a result of the inventive creation of the transformation database, different settings C $(Z_z, U_x(C_y))$ are stored in the database in a parameterized form, which are to be set for each changeover from one hearing device type $U_x$ to another hearing device type $Z_z$ for each checked setting $C_y$ of each source hearing device $U_x$ on the target hearing device $Z_z$ to replace the source hearing device $U_x$. The effort involved in collecting data is firstly comparable with a setting of a hearing device on the basis of a predetermined characteristic without using a database. It immediately decreases however if an exchange is repeated with corresponding specifications in respect of the characteristic and with the same hearing device type. A further advantage of the creation of the transformation database consists in this largely being possible independently of the hearing device wearer under lab conditions and already being available in prepared form during the actual adjustment of a new hearing device on the patient. A further advantage of the provision of an inventive transformation database consists in a considerable competitive advantage of making the hearing devices available, which are supplied with model-dependent transformation data.

Figure 2:
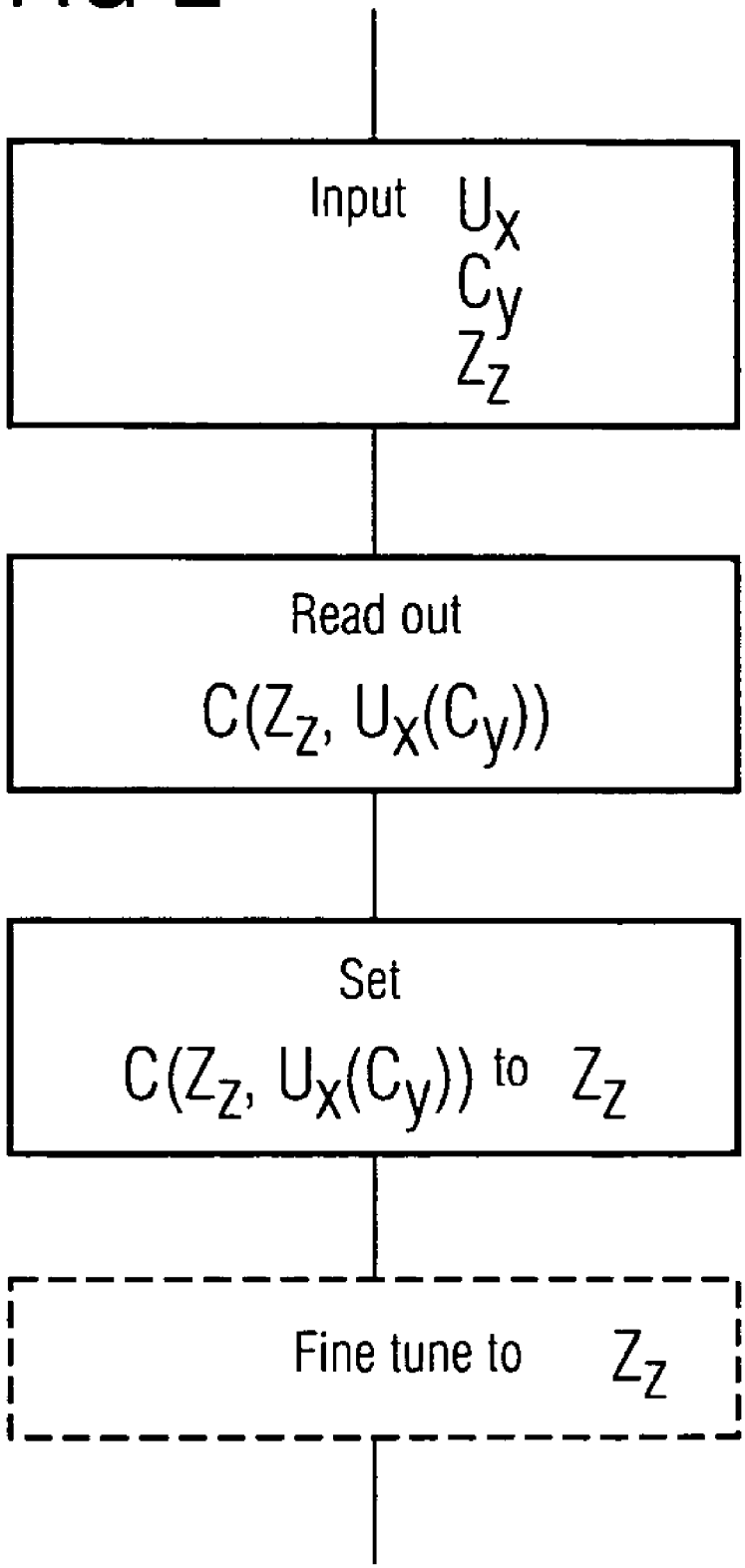
FIG. 2 shows a program flowchart of the inventive method during the adjustment of a hearing device.

FIG. 2 shows a program flowchart of the inventive method during the adjustment of a hearing device. The instance of an adjustment of a hearing device after the replacement of another hearing device on the patient is significantly simplified by the available transformation database. In a first step, the type of source hearing device $U_x$, the setting C on this hearing device which exists at the time of the replacement as well as the type of target hearing device $Z_z$, which is to replace the source hearing device $U_x$ in the future, are input. The setting C $(Z_z, U_x(C_y))$ stored in respect of these inputs is then read out. As a result of this data set, execution of the setting C $(Z_z, U_x(C_y))$ on the target hearing device $Z_z$ is possible, which can take place manually or in an automated fashion. As a result of the aforementioned discretization of the adjustment ranges of the control variables, it necessarily follows that an inventive setting using the transformation database cannot be sufficiently precise to rediscover a familiar characteristic of a hearing device. If the achievable accuracy during the reproduction of the conventional acoustic characteristic is not perceived as adequate by the target hearing device $Z_z$ to be worn in the future, the inventively obtained setting C $(Z_z, U_x(C_y))$ can be used as a first-fit setting, from which a fine tuning can be performed on the basis hereof using measuring technology, which however already considerably reduces the outlay required for this fine tuning compared with other methods according to the prior art as a result of the generally minimal deviation requirements from the first-fit setting. This nevertheless represents an option which is not necessary in each case, since the achievable accuracy is quite sufficient for many hearing device wearers without additional fine tuning.

Figure 3:
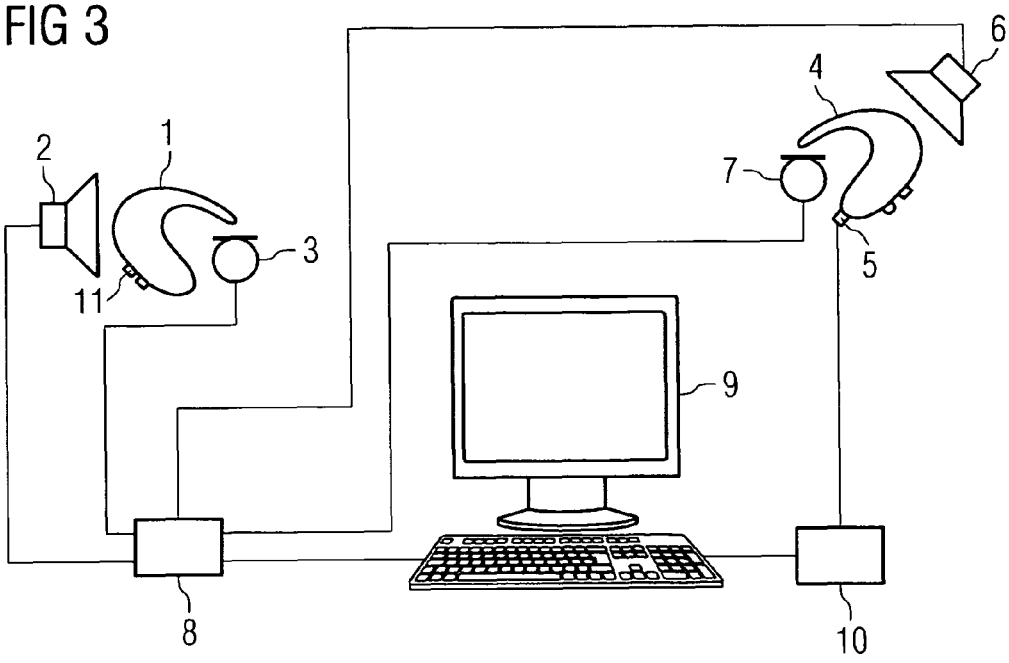
FIG. 3 shows an arrangement for the inventive data acquisition during the creation of the transformation database.

FIG. 3 shows an arrangement for the inventive data acquisition during the creation of the transformation database. The arrangement includes a source hearing device 1 to be replaced, the transmission and amplifying characteristics of which can be determined. The determination of the transmission and amplifying characteristics is carried out with the aid of a sound-generating device in the form of a loudspeaker 2 and a microphone 3, which is arranged directly upstream of the source hearing device 1.

The arrangement also includes a target hearing device 4, which is to replace the source hearing device 1 to be replaced. The target hearing device 4 has an electronically controllable control unit 5, by way of which a computer-aided setting of different parameters can be performed. A sound-generating device in the form of a loudspeaker 6 and microphone 7 is likewise arranged directly adjacent to the target hearing device 4, with the aid of which the transmission and amplifying characteristics of the target hearing device 4 can be determined. The loudspeakers 2 and 6 as well as the microphones 3 and 7 are connected to a measurement circuit 8, which can control the loudspeakers 2 and 6 such that they can generate defined sound levels with predetermined frequencies, while the microphones 3 and 7 each detect the acoustic response of the hearing devices 1 and 4 to the predetermined sound level and convey their output signals to the measurement circuit 8. The measurement circuit 8 is connected to a computer 9, in which the output signals of the microphones 3 and 7 can be evaluated and the specifications in respect of the control of the loudspeakers 2 and 6 are determined and forwarded to the measurement circuit 8. The computer 9 is also connected to a driver circuit 10. The driver circuit 10 allows an automated adjustment of the adjustable parameters and/or control parameters of the target hearing device 4 to be carried out by actuating the electronically actuatable control unit 5. An arrangement of this type allows the inventive creation of the transformation database to be implemented, by the hearing devices 1 and 4 being exchanged, step by step, with other types in each instance. In the present exemplary embodiment, the variation of the settings on the source hearing device 1 is performed manually by way of control elements 11. Alternatively, an automated variation is however possible provided the source hearing device 1 has corresponding electronically controllable control units which are similar to the target hearing device 4.

For a predetermined setting $U_x(C_y)$ on the source hearing device 1, the transmission and amplifying characteristics of the source hearing device 1 are determined by a corresponding acoustic irradiation and adjustment with the aid of the loudspeaker 2, the microphone 3, the measurement circuit 8 and the computer 9. An automated parameter variation is then carried out on the target hearing device 4 until an identical and/or similar transmission and amplifying characteristic is set hereupon, which can likewise be checked by interaction of the loudspeaker 6, the microphone 7, the measurement circuit 8 and the computer 9. Upon achieving the desired transmission and amplifying characteristics on the target hearing device 4, the setting C ($Z_z$, $U_x(C_y)$) is read out, with it being possible for the reading-out to take place automatically by way of the electronically controllable control unit 5, which has a corresponding interface for this purpose. The read-out setting C ($Z_z$, $U_x(C_y)$) is stored in the transformation database on the computer 9.

Figure 4:
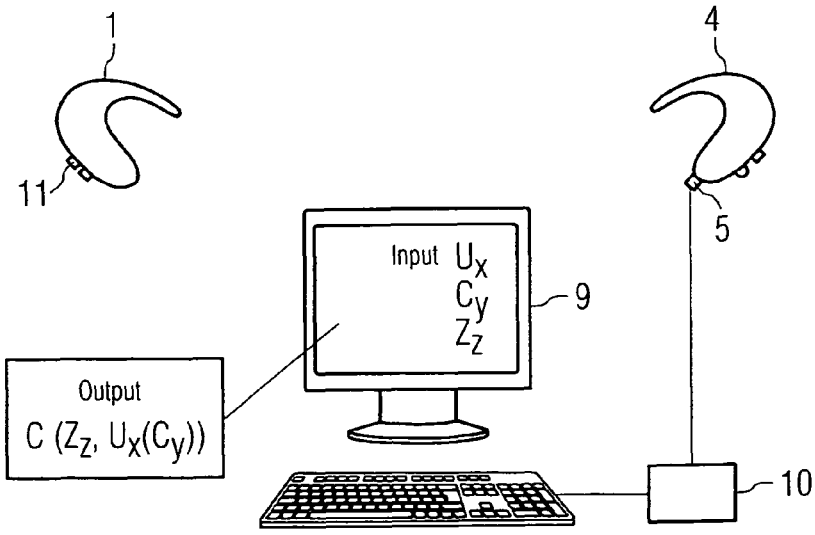
FIG. 4 shows an arrangement for the inventive adjustment of a hearing device.

FIG. 4 shows an arrangement for the inventive adjustment of a hearing device. An input of the type $U_x$ of the source hearing device 1, the setting $C_y$ which exists at the time of the replacement on the source hearing device 1 and the type $Z_z$ of the target hearing device 5 to be adjusted is necessary for this adjustment of a target hearing device 4. The computer determines the setting C ($Z_z$, $U_x(C_y)$), which has to be performed on the target hearing device 4, from the transformation database, in order to achieve a transmission characteristic hereupon which equates to that which existed last on the source hearing device 1. The setting on the target hearing device 4 can take place automatically. To this end, the computer 9 is connected to a driver circuit 10, which interacts with an electronically controllable control unit 5. An adjustment of hearing devices 1, 4 is unnecessary in this example as a result of the access to the transformation database.

Figure 5:
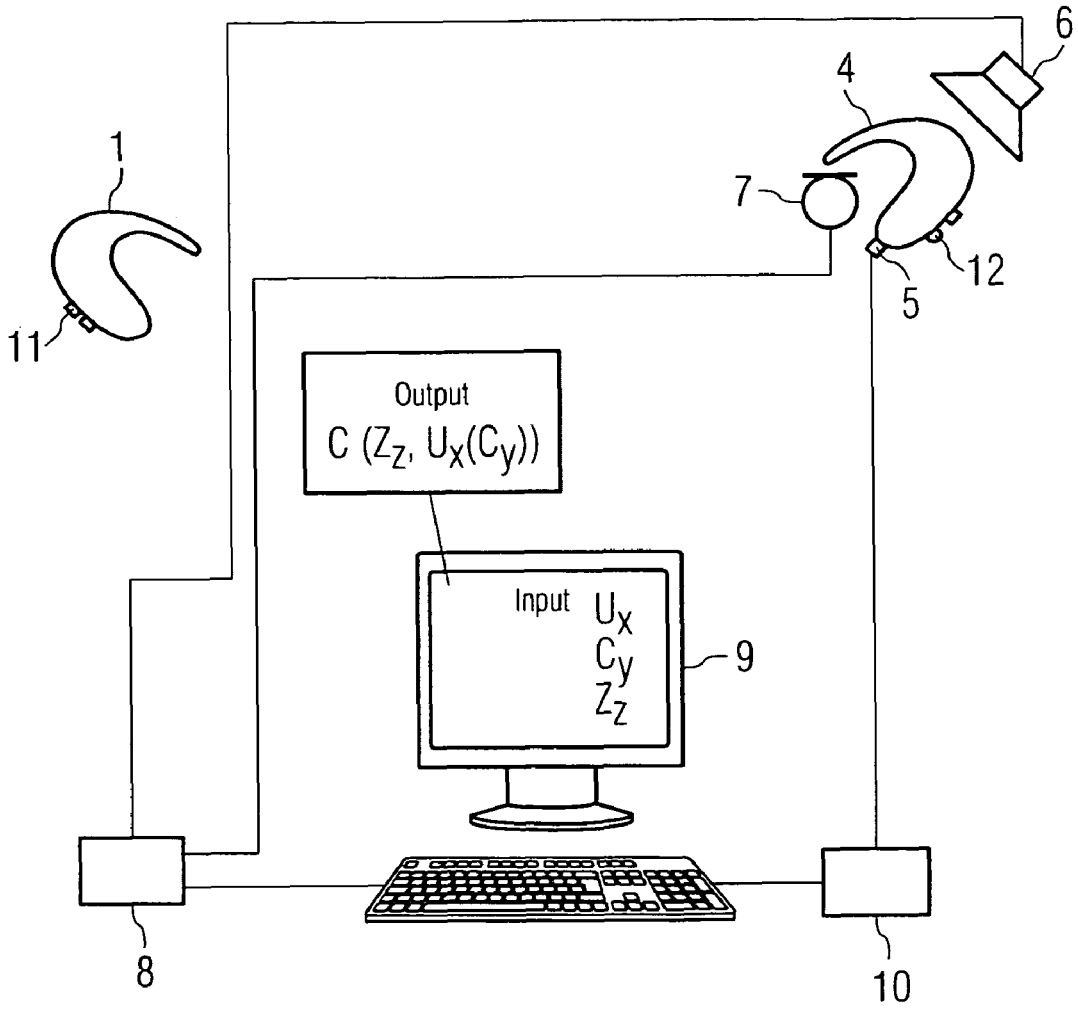
FIG. 5 shows a further arrangement for the inventive arrangement of a hearing device.

FIG. 5 shows a further arrangement for the inventive adjustment of a hearing device. This firstly includes, similarly to the exemplary embodiment according to FIG. 4, the technical means which are needed for an exclusively database-assisted adjustment of the target hearing device 4. Further means are also included, which are needed for an acoustic adjustment of the target hearing device 4. These means include in detail a measurement circuit 8 which is connected to the computer 9 but is also connected to a loudspeaker 6 and a microphone 7. The inventively obtained setting C ($Z_z$, $U_x(C_y)$) is used in this instance as a first-fit setting, on the basis of which a fine tuning is performed using measurement technology. This fine tuning results in a characteristic of the target hearing device 4, for which no pretested setting C ($Z_z$, $U_x(C_y)$) is stored in the transformation database. A large part of the effort for the setting of this characteristic is however eliminated by means of the inventive setting of the first-fit setting C ($Z_z$, $U_x(C_y)$). The possibility also exists by way of control elements 12 of directly influencing the adjustment of the target hearing device 2.

The handling of the stored data is advantageously facilitated if the transformation database is structured such that the querying of data can take place by way of an input mask.

The invention claimed is:

1. A method for setting target hearing device based on a characteristic of a source hearing device, comprising:

creating a transformation database;

identifying the source hearing device;

identifying a setting of the source hearing device;

determining a characteristic of the source hearing device when the source hearing device is set to the identified setting;

retrieving a setting via the transformation database, the retrieved setting being such that when set to the target hearing, device the resulting characteristic of the target hearing device corresponds to the determined characteristic of the source hearing device when it is set to identified setting wherein said retrieving is based on an inset that specifies the identified source hearing device, the target hearing device, and the identified setting of the source hearing device;

setting the target hearing device with the retrieved setting, wherein the source hearing device and the target hearing device are different, and wherein the transformation database is created to store settings which have to be set on hearing devices of different types, in order to assign to these hearing devices the characteristic of other hearing devices with identified settings.

2. The method as claimed in claim 1, wherein for the creation of the transformation database, the source hearing device is acoustically adjusted during the setting, the setting is determined on the target hearing device, with which the target hearing device has a characteristic which equates to that characteristic which was determined by the acoustic adjustment of the source hearing device, and the parameters of the setting are linked to the type of source hearing device, the adjusted setting of the source hearing device and the type of the target hearing device and are stored as a data set.

3. The method as claimed in claim 1, wherein for the creation of the transformation database on the source hearing device, several different settings are acoustically adjusted, the settings are determined on the target hearing device, with which the target hearing device has a characteristic which equates in each instance to that characteristic which was determined by the acoustic adjustment of the source hearing device, and the parameters of the setting are connected to the type of source hearing device, the measured settings of the source hearing device and the type of the target hearing device and are stored as data sets.

4. The method as claimed in claim 1, wherein for the creation of the transformation database, several different settings are acoustically adjusted on several source hearing devices, the settings are determined on the target hearing device, with which the target hearing device has a characteristic which equates in each instance to that characteristic which was determined by the acoustic adjustment of the source hearing device, and the parameters of the settings are linked to the type of the source hearing devices, the measured settings of the source hearing devices and the type of the target hearing device and are stored as data sets.

5. The method as claimed in claim 1, wherein for the creation of the transformation database, several different settings are acoustically adjusted on several source hearing devices, the settings are deter mined on several target hearing devices, with which the target hearing devices have a characteristic which equates in each instance to that characteristic which was determined by the acoustic adjustment of the source hearing devices, and the parameters of the settings are linked to the type of the source hearing devices, the adjusted settings of the source hearing devices and the type of the target hearing devices and are stored as data sets.

6. The method as claimed in claim 1, wherein the source hearing device is adjusted acoustically with all settings which are available thereto.

7. The method as claimed in claim 1, wherein the setting is used as a first-fit setting, which is then subjected to a fine tuning.

8. An apparatus for setting a characteristic of a first hearing device on a second hearing device, comprising:

a source hearing device;

a target hearing device;

means for determining the characteristic of the source hearing device;

means for adjusting the characteristic of the target hearing device to the characteristic of the source hearing device;

means for determining the setting required to adjust the characteristic of the target hearing device; and means for storing the determined setting, wherein the means for storing the determined settings comprises a computer, on which the determined settings can be stored or requested in the form of a transformation database, wherein the transformation database is created to store settings which have to be set on hearing devices of different types, in order to assign to these hearing devices the characteristic of other hearing devices with identified settings.

9. The apparatus as claimed in claim 8, wherein the means for determining the characteristic of the source hearing device include means for the acoustic adjustment of the source hearing device.

10. The apparatus as claimed in claim 8, wherein the means for adjusting the characteristic of the target hearing device include means for the acoustic adjustment of the target hearing device and means for varying the setting of the target hearing device.

11. The apparatus as claimed in claim 8, wherein the means for determining the setting of the target hearing device include an interface for reading out the setting.

12. The apparatus as claimed in claim 8, wherein the transformation database is structured such that the data is queried by way of an input mask.

13. The apparatus as claimed in claim 8, wherein the means are included, which can effect this setting on the target hearing device after reading out a setting from the transformation database.

14. The apparatus as claimed in claim 9, wherein the means for adjusting the characteristic of the target hearing device include means for the acoustic adjustment of the target hearing device and means for varying the setting of the target hearing device.

15. The apparatus as claimed in claim 10, wherein the means for determining the setting of the target hearing device include an interface for reading out the setting.

16. The apparatus as claimed in claim 15, wherein the means for storing the determined settings include a computer, upon which the specific settings are stored and queried in the faun of a transformation database.

17. The apparatus as claimed in claim 16, wherein the transformation database is structured such that the data is queried by way of an input mask.

18. The apparatus as claimed in claim 17, wherein the means are included, which can effect this setting on the target hearing device after reading out a setting from the transformation database.

* * * * *